US010773148B1

(12) United States Patent
Krafchick

(10) Patent No.: US 10,773,148 B1
(45) Date of Patent: Sep. 15, 2020

(54) DEVICE AND METHOD FOR SCORING

(71) Applicant: Joshua Daniel Krafchick, Jacksonville Beach, FL (US)

(72) Inventor: Joshua Daniel Krafchick, Jacksonville Beach, FL (US)

( * ) Notice: Subject to any disclaimer, the term of this patent is extended or adjusted under 35 U.S.C. 154(b) by 0 days.

(21) Appl. No.: 16/558,110

(22) Filed: Sep. 1, 2019

(51) Int. Cl.
*A63B 71/06* (2006.01)

(52) U.S. Cl.
CPC ..... *A63B 71/0672* (2013.01)

(58) Field of Classification Search
CPC ..... A63B 71/0672
USPC ..... 281/2, 3.1, 5, 7, 14; 283/67, 48.1, 49, 283/61, 62, 65
See application file for complete search history.

(56) References Cited

U.S. PATENT DOCUMENTS 2,210,452 A * 8/1940 Garland ..... A63B 71/06 40/472
2,226,906 A 12/1940 Henderson et al.
2,230,927 A 2/1941 Bowman et al.
2,330,799 A * 10/1943 Coker ..... A63B 71/06 353/45
2,437,018 A * 3/1948 Dodson ..... A63B 71/06 439/49
3,113,779 A * 12/1963 Guenther ..... A63F 11/00 273/148 R
3,462,853 A * 8/1969 Kunert ..... G09B 3/06 434/326
3,735,506 A * 5/1973 Kunert ..... G09B 3/08 434/346
3,739,739 A 6/1973 Brase
4,916,827 A 4/1990 Rayburn
5,582,128 A * 12/1996 Wollan ..... G09F 11/00 116/225
5,938,198 A * 8/1999 Kostecki ..... A63B 71/06 273/148 R
2010/0012541 A1* 1/2010 Neary ..... G09B 3/06 206/425
2015/0190702 A1* 7/2015 Roness ..... A63B 71/0669 116/201

* cited by examiner

*Primary Examiner* — Justin V Lewis
(74) *Attorney, Agent, or Firm* — Mark Young, PA

(57) ABSTRACT

A scorecard holder and method of scoring exposes one round of scores at a time, concealing all previous scores. The holder is an sleeve-like structure into which a scorecard is inserted. A window exposes the current round for scoring. Linear or rotational movement of the scorecard, relative to the holder, positions the round in the window. After a score has been entered, the scorecard may be moved relative to the holder to expose, in the window, the next round.

17 Claims, 13 Drawing Sheets

DEVICE AND METHOD FOR SCORING

FIELD OF THE INVENTION

This invention relates generally to scoring, and, more particularly, for scoring a task, event or game with several rounds of activity or play, with only the score of current round exposed, and all scores for prior rounds concealed.

BACKGROUND

Tracking one's score can distract a player and lead to misery. Golfers spend their hard earned money to do something that they should enjoy. Yet so many golfers leave the course miserable. Often, scoring is the culprit. Scores have a tendency to separate golfers. The constant reminder of past shortcomings as displayed on a scorecard leads to avoidable mistakes. Discontent over a prior hole, distracts a golfer. The reminder of past performance interferes with fellowship among a group of golfers. Past scores often negatively influence play on the next holes. Golfers troubled by their prior performance may take risks in an effort to save a stroke. Distraction by prior performance can compromise a golfer's mechanics.

To be generally aware of score is fine. However, it can be liberating and spiritual to play without feeling accountable. The outdoors is a reinvigorating environment. Focusing on results takes away from the moment.

Concomitantly, a score is a good measure of performance. Often, one or more golfers in a group will insist on scoring.

What is needed is a means and method of keeping score without reminding golfers of their scores on prior holes throughout a round of play.

The invention is directed to overcoming one or more of the problems and solving one or more of the needs as set forth above.

SUMMARY OF THE INVENTION

To solve one or more of the problems set forth above, in an exemplary implementation of the invention, a scorecard holder and method of scoring according to principles of the invention exposes one round of scores at a time, concealing all other scores. The scorecard holder is sleeve-like structure, with an opening into which a scorecard is inserted. A window is positioned and sized to expose the round of scores. The window allows a user to write, with a pen or pencil, on the exposed portion of the scorecard, a score for the exposed round. Movement of the scorecard, relative to the holder, positions one round of scores in the window. Such movement may be linear or rotational. After a score has been entered, the scorecard may be moved relative to the holder to expose, in the window, the next round, for scoring. In this manner, all previously scored rounds are concealed within the holder. Thus, a player is relieved of the burden and distraction of prior scores. This allows a player to enjoy and focus exclusively on the current round. A round may be a round of golf, a frame of bowling, a game of tennis, an inning of baseball or cricket, a quarter of football, a period of basketball or hockey, an event in a triathlon, decathlon or other combined event competition, or any other determined portion of an event, game or task for which a score may be recorded.

A method of scoring a plurality of rounds of play, according to principles of the invention, includes steps of inserting a scorecard into a holder. The scorecard is a sheet (e.g., a rectangular or circular [i.e. disc-shaped] sheet) with a surface on which indicia is displayed. The indicia includes an identifier, such as an integer, for each of a plurality of rounds and a scoring space for each identifier (i.e., a scoring space for each round). Each identifier and scoring space is separated from each other identifier and scoring space, such that one identifier and scoring space for one round may be displayed in the window of the holder (described below) at a time.

The holder has an upper panel, a lower panel, and a compartment between the upper panel and lower panel. The compartment is sized and shaped to receive the scorecard. A window is formed in the upper panel. The window is sized and shaped to expose a scoring space and an identifier for a round of the plurality of rounds. To facilitate handling the inserted scorecard, the holder may include a concavity, such as a cutout or cove, that facilitates grasping or engaging the scorecard. The compartment of the holder is sized to receive enough of the scorecard to allow the identifier and scoring space for each round to be aligned with the window, one round at a time.

The scorecard may be moved relative to the holder to align, with the window of the holder, the identifier and scoring space for a round. The movement may be linear or rotational. After a round of play, a score is written in the scoring space exposed in the window. Then the scorecard is moved to expose, in the window, the identifier and scoring space for the next round. The steps of writing a score and moving the scorecard to expose, in the window, the identifier and scoring space for the next round are repeated until all rounds of play have been scored.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
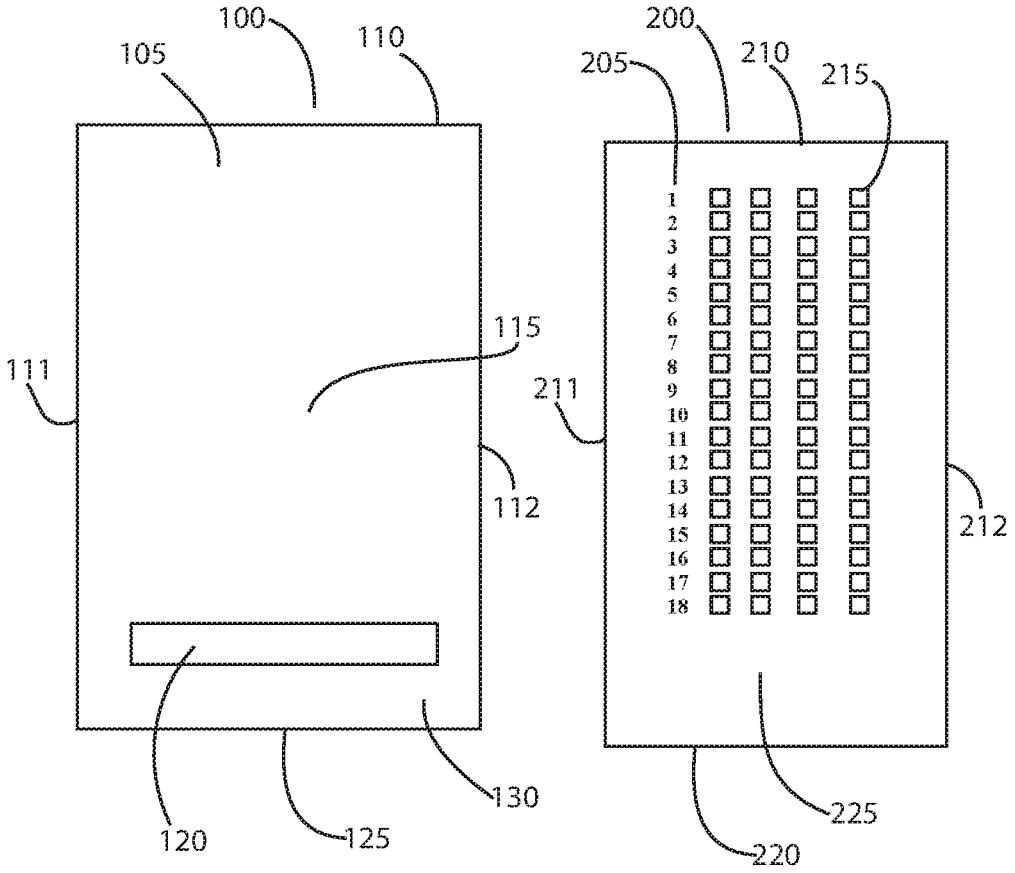
FIG. 1 is a plan view of an exemplary holder and scorecard according to principles of the invention.

Referring to FIG. 1, a plan view of an exemplary holder 100 and scorecard 200 is provided. The holder 100 is a sleeve-like structure that is shaped and sized to receive at least a substantial portion of the score card 200, i.e., at least the portion that contains round numbers 205 and score spaces 215. The holder 100 includes a top edge 110 and an opposite bottom edge 125, and opposite side edges 111, 112.

A window 120 exposes each round 205 and space 215 for scoring. The window 120 is an uncovered opening in the upper panel 115. The window 120 is positioned, sized and shaped to expose a round 205 and scoring space 215, while all spaces that have been scored previously are concealed beneath the top portion 105 of the upper panel 115. In the exemplary embodiment, the window 120 exposes one round at a time. However, the window 120 may be sized to expose more than one previously unscored round at a time.

The bottom portion 130 of the upper panel 115 beneath the window is optional. Without the bottom portion 130, the window 120 would extend to the bottom edge 125, and thereby expose more than one previously unscored round at a time.

The scorecard 200 includes an upper surface 225 a top edge 210, an opposite bottom edge 220, and side edges 211, 212. The width of the scorecard 200 measured from side edge 211 to side edge 212 is less than the width of the holder 100 measured from side edge 111 to side edge 112, to allow the scorecard to slide into the holder 100.

The upper surface 225 of the scorecard 200 includes columns and rows of indicia, including a column of printed rounds 205, numbered 1 through 18, and four scoring spaces 215 per round. Fewer or more than 4 scoring spaces per round may be provided. By way of example and not limitation, one scoring space may be provided for one player per round. Alternatively, as shown, 4 scoring spaces, one for each of up to 4 players, may be provided per round. Each scoring space is an area in which a score may be written for a player for the round. In the exemplary embodiment, each scoring space is defined by a printed square 215.

Figure 2:
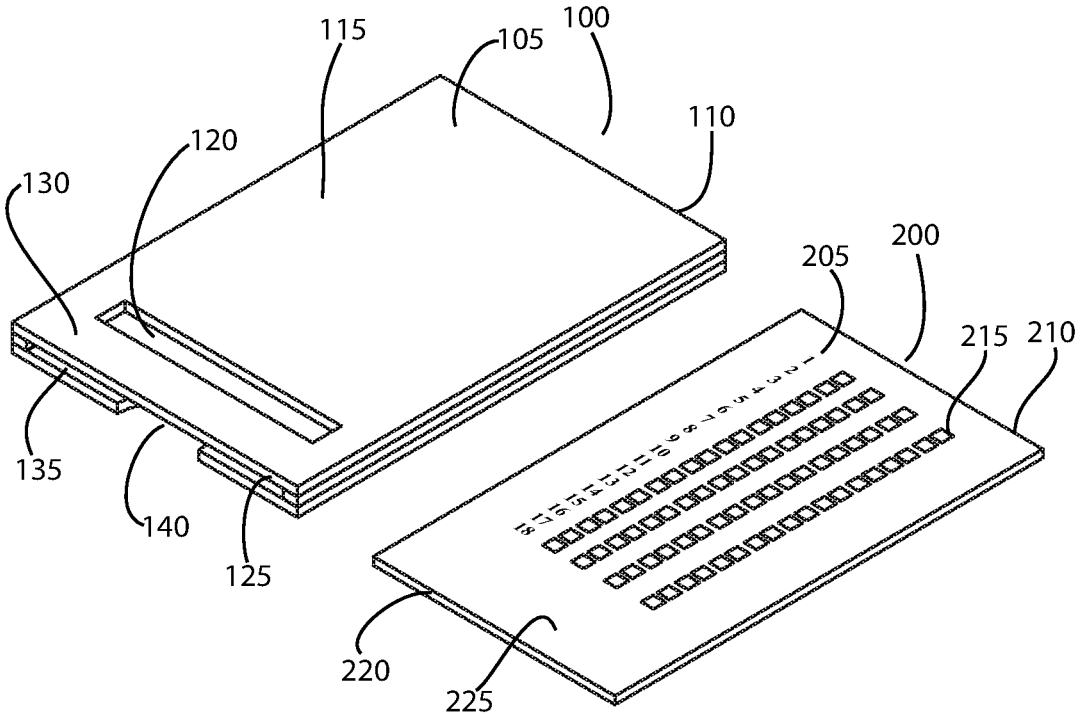
FIG. 2 is a perspective view of an exemplary holder and scorecard according to principles of the invention.
Figure 3:
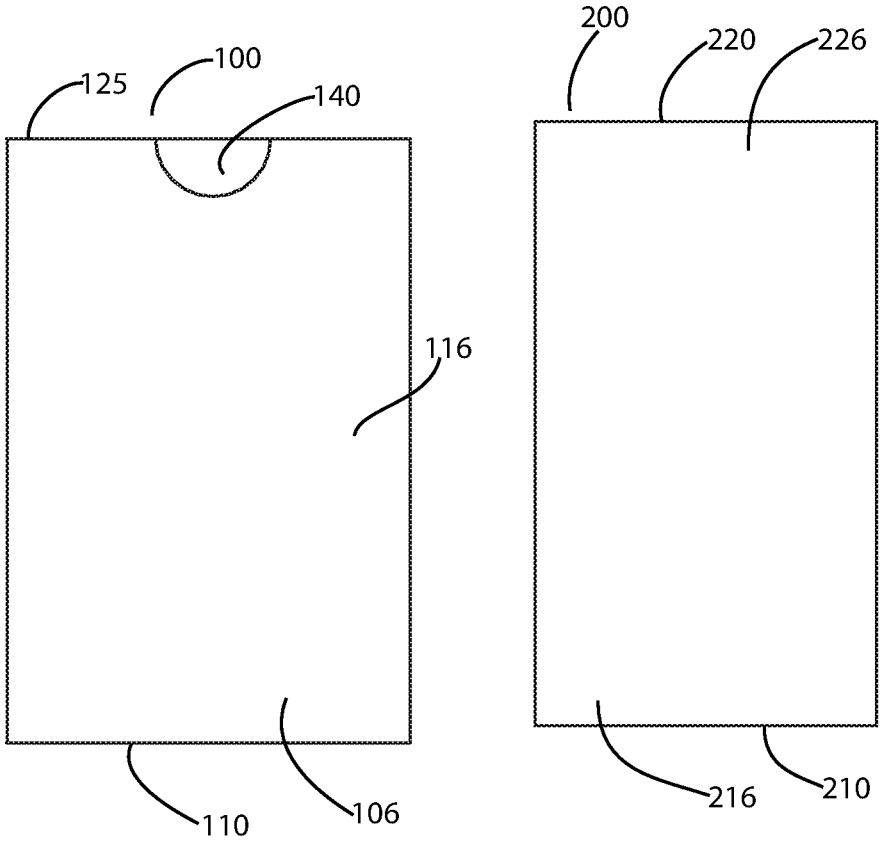
FIG. 3 is a bottom view of an exemplary holder and scorecard according to principles of the invention.

The perspective view of FIG. 2 more clearly illustrates the relative thicknesses of the scorecard 200 and holder 100, the compartment 135 of the sleeve-like structure of the holder 100 into which the scorecard 200 is received, and a cutout 140 to facilitate removal of the scorecard 200 from the compartment 135 of the holder 100. As illustrated, the thickness of the scorecard 200, measured from the upper surface 225 to the opposite lower surface 226 (FIG. 3) is less than the thickness of the holder 100, measured from the top panel 115 to the lower panel 116 (FIG. 3). The scorecard 200 is thin enough to slide into the compartment 135 defined between the top panel 115 and the lower panel 116 of the holder 100.

The compartment 135 is defined between the upper panel 115 and lower panel 116 of the holder 100. The compartment 135 is accessible through an opening at the bottom edge 125 of the holder 100. The compartment 135 is shaped and sized to receive at least a substantial portion of the scorecard 200, i.e., at least to the extent that the last row of rounds 205 and score spaces 215 is exposed in the window 120.

To facilitate removal of a scorecard 200 from the holder 100, a fingertip shaped cutout 140 may be provided in the lower panel 116 and/or in the top panel 115 of the holder 100 at the bottom edge 125. The cutout 140 enables fingertip engagement of a portion of the scorecard 200 near the bottom edge 220 of the scorecard 200, even when the scorecard 200 is fully inserted into the holder 100. Additionally, or alternatively, the bottom portion of the scorecard 200, measured from the last row of rounds and scoring spaces to the bottom edge 220, may be elongated. The elongated bottom portion may extend outwardly from the bottom edge 125 of the holder 100, even when the scorecard 200 is fully inserted to the extent that the last row of rounds 205 and score spaces 215 is exposed in the window 120.

Figure 4:
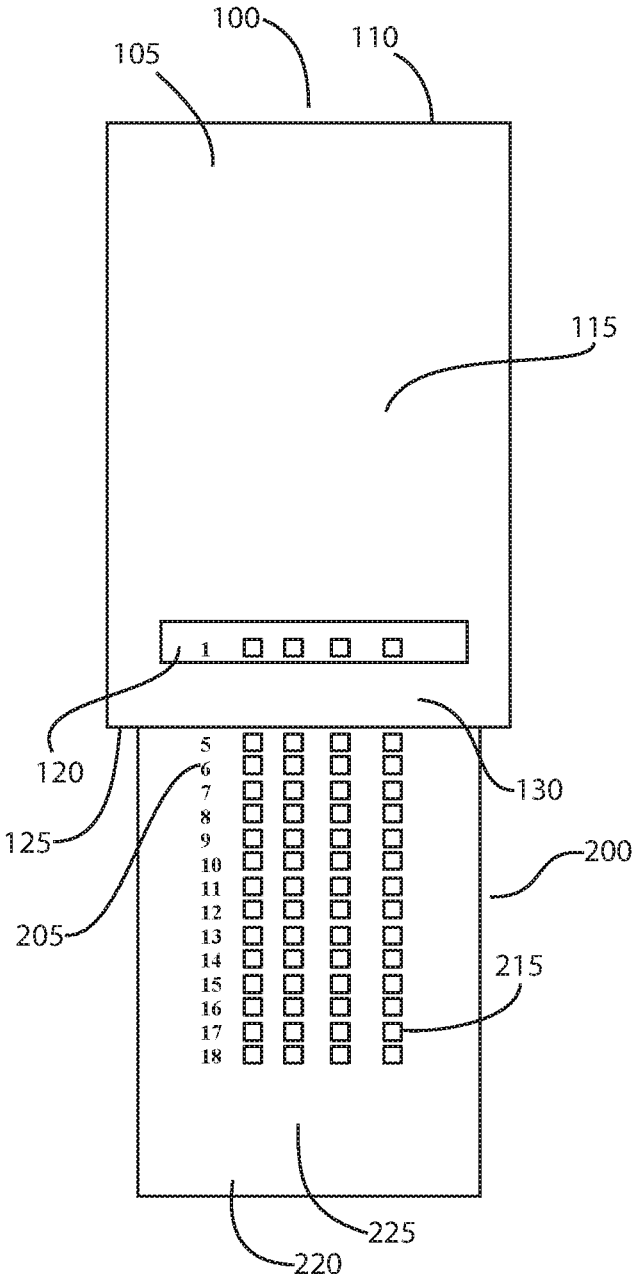
FIG. 4 is a plan view of an exemplary holder receiving a scorecard according to principles of the invention.
Figure 5:
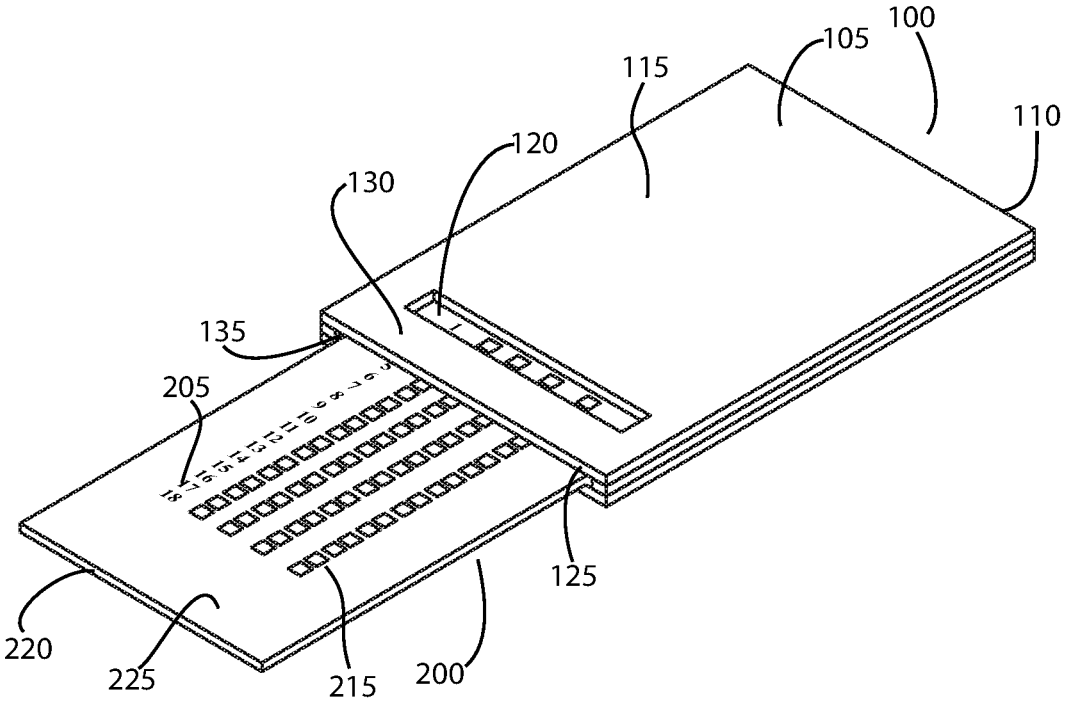
FIG. 5 is a perspective view of an exemplary holder receiving a scorecard according to principles of the invention.
Figure 6:
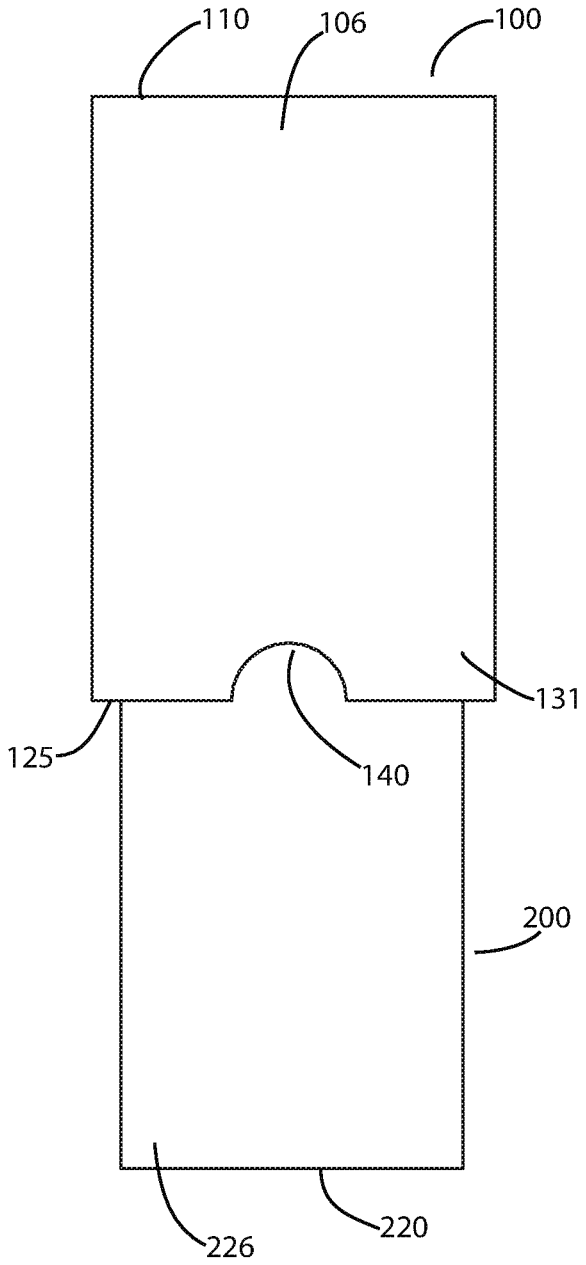
FIG. 6 is a bottom view of an exemplary holder receiving a scorecard according to principles of the invention.

Referring to FIGS. 4-6 the scorecard 200 is shown partially inserted in the compartment 135. The first row of rounds 205 and scoring spaces 215 is exposed in the window 120. A user may enter one or more scores for the round, in the spaces provided, with a pen or pencil. Then the scorecard 200 may be inserted further to expose the next round and corresponding spaces. Upon such further insertion, the previous scored round is no longer exposed. Rather, the previous scored round is concealed beneath the upper panel 115. The steps of scoring a round and then further inserting (i.e., advancing) the scorecard 100 into the compartment 135 may be repeated until the last round is scored.

Figure 7:
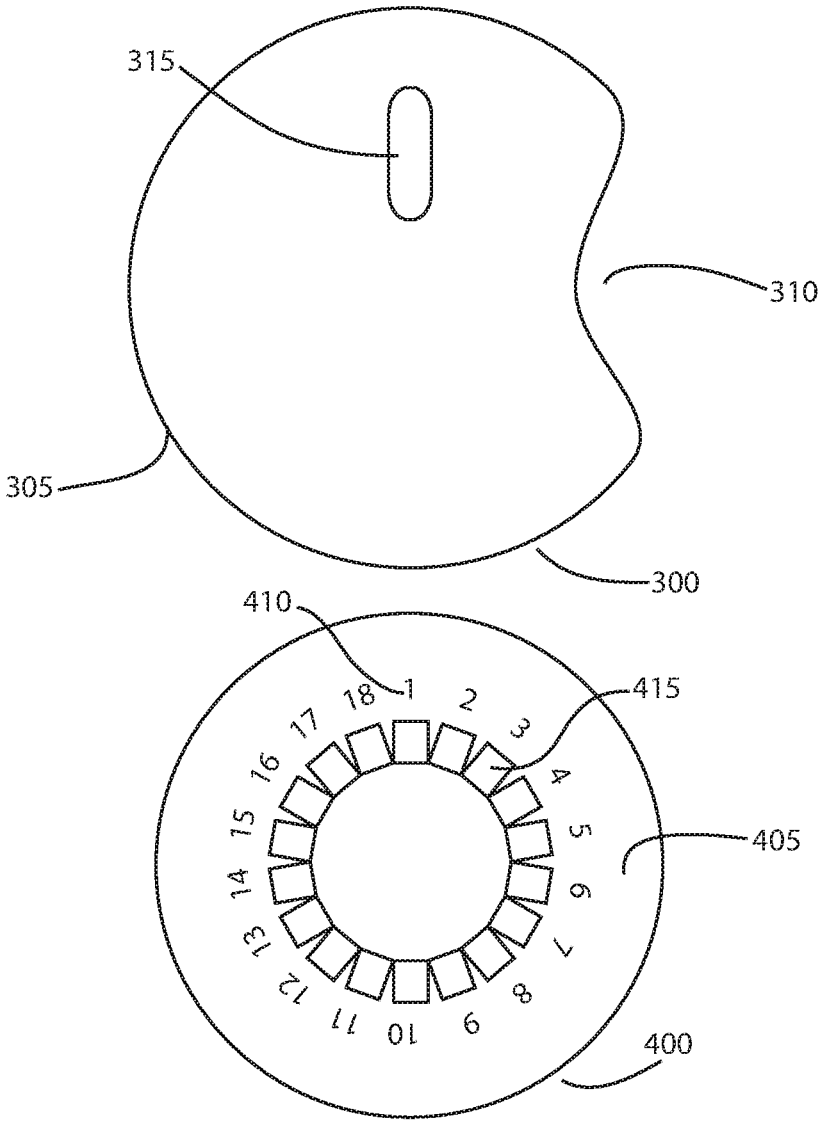
FIG. 7 is a plan view of another exemplary holder and scorecard according to principles of the invention.
Figure 8:
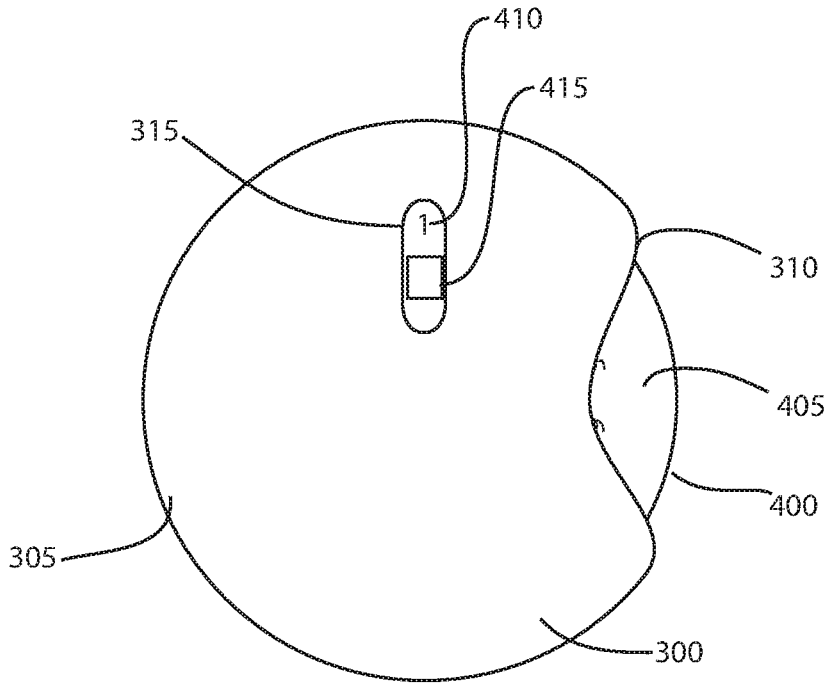
FIG. 8 is a plan view of the exemplary holder of FIG. 7 receiving a scorecard according to principles of the invention.

Referring to FIGS. 7 and 8, an alternative embodiment of the invention is shown. The scorecard 400 is a disc-shaped panel 405. The rounds 410 and score spaces 415 are arranged in a radial pattern, with each round and corresponding score space(s) aligned along a radius. In the case of 18 rounds, each radius may be 20 degrees apart from the next radius for a total of 360 degrees. The holder 300 is also disc-shaped, with a cove 310 to expose an edge of the scorecard 400. The holder 300 may be comprised of an upper panel 305 and a similarly shaped lower panel, with a compartment defined between the two panels. The compartment of the holder 300 is sized and shaped to receive at least a substantial portion of the scorecard 400, except a portion of the scorecard 400 exposed by the cove 310. The exposed edge of the scorecard 400 may be engaged to manually rotate the scorecard 400 within the holder 300 for the purpose of advancing the round 410 and score space(s) 415 exposed in the window 315 of the holder 315. The window 315 is positioned, shaped and sized to expose one round and corresponding score space(s) at a time. As shown in FIG. 8, the cove 310 is shallow enough to allow the holder 300 to conceal the score spaces even along the exposed edge of the panel 405 of the scorecard 400, because the radial distance of the score spaces 415 (measured from the center of scorecard 400) is less than the radial distance of innermost part of the cove 310 (measured from the center of the holder 300).

In use, the first row (radius) of rounds 410 and scoring space(s) 415 is exposed in the window 315. A user may enter one or more scores for the round, in the space(s) provided, with a pen or pencil. Then the scorecard 400 may be advanced (i.e., rotated), until the next round and corresponding space(s) is exposed in the window 315 for scoring. Upon such advancement, the previous scored round is no longer exposed. Rather, the previous scored round is concealed beneath the upper panel 305. The steps of scoring a round and then further rotating (i.e., advancing) the scorecard 400 relative to the compartment 300 may be repeated until the last round is scored.

Figure 9:
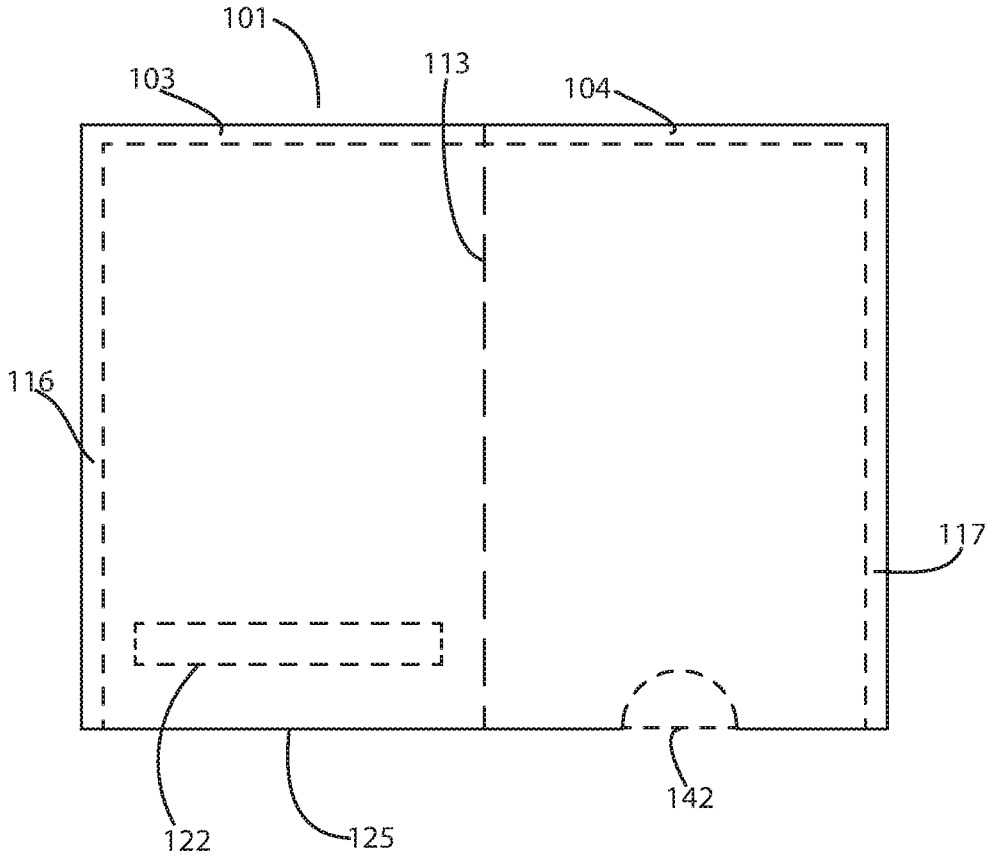
FIG. 9 is a plan view of a sheet for constructing the exemplary holder of FIG. 1 according to principles of the invention.

An exemplary holder 100, 300 may be constructed of a single elongate sheet of material. With reference to FIG. 9, rectangular section 122 may be removed by cutting or pressing with a die to form the window 122. Likewise, semi-circular section 142 may be removed by die cutting or another cutting operation to form the cutout 140. After forming the window 120 and cutout 140, the holder 100 of FIG. 1, may be constructed from the sheet 101 by folding along fold line 113, and bonding along edges 103, 104 and 116, 117, with edge 103 overlaying and being bonded to edge 104 and edge 116 overlaying and being bonded to edge 117.

Figure 10:
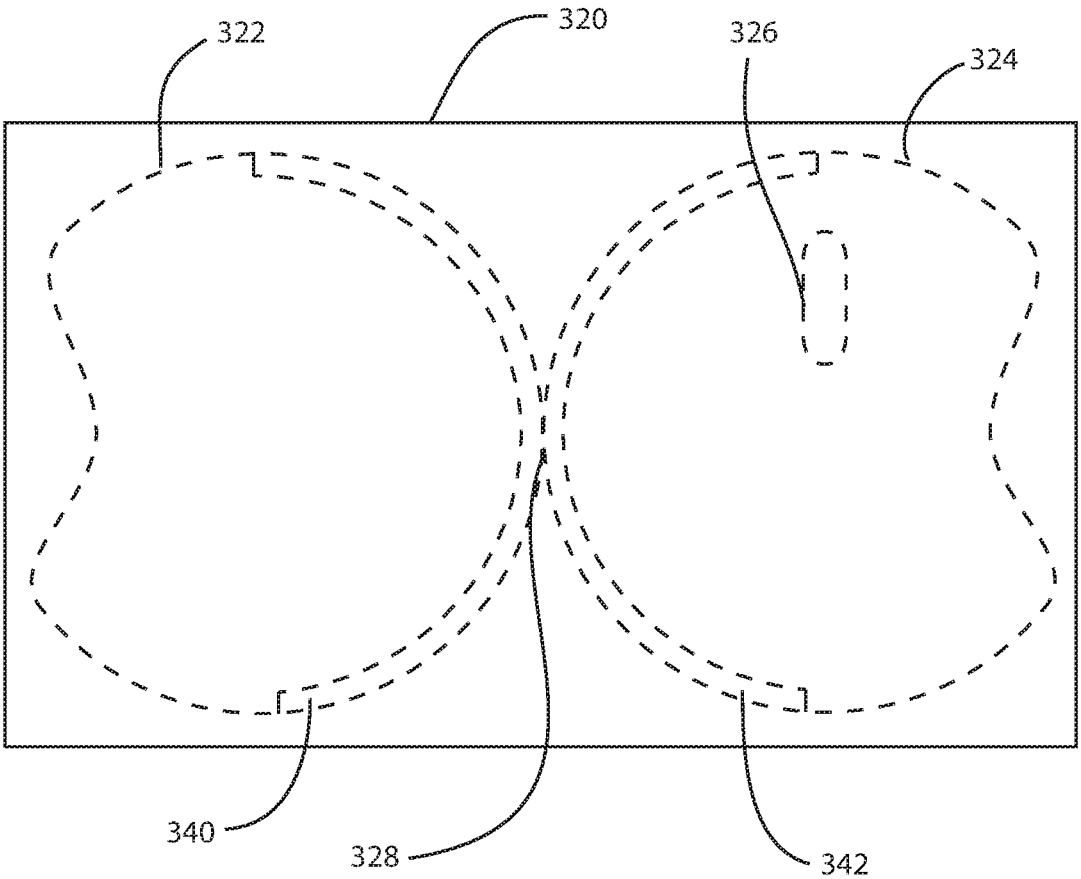
FIG. 10 is a plan view of a sheet for constructing the exemplary holder of FIG. 7 according to principles of the invention.

With reference to FIG. 10, section 326 may be removed by cutting or pressing with a die to form the window 315. Likewise, sections 322, 324 may be removed from sheet 320, as a unitary piece or as separate pieces by die cutting or another cutting operation to form the upper and lower panels of holder 300. After such cutting, the holder 300 of FIG. 7, may be constructed by folding along fold line 328 if the removed piece is unitary, and bonding along edges 340, 342 with edge 342 overlaying and being bonded to edge 340.

While the edges are preferably bonded together using an adhesive, such as hot melt or water based adhesive, it should be understood that any other means known in the art for securing the edges together would be suitable for purposes of this invention, including the use of staples, ultrasonic welding, or rivets. The sheet material may, by way of example and not limitation, comprise paper, card stock, Mylar, polypropylene, polyvinylchloride, or any other material suitable for production of envelopes and/or file folders.

The assembled size of a holder according to principles of the invention, is any size adequate to accommodate the scorecard intended to be inserted into the holder. The size of the scorecard will depend upon the number of rounds, scoring spaces per round, and other indicia presented on the scorecard. Each scoring space should be of sufficient size for writing a score. The window 120, 315 should be of sufficient size to expose a round and corresponding scoring spaces.

Figure 11:
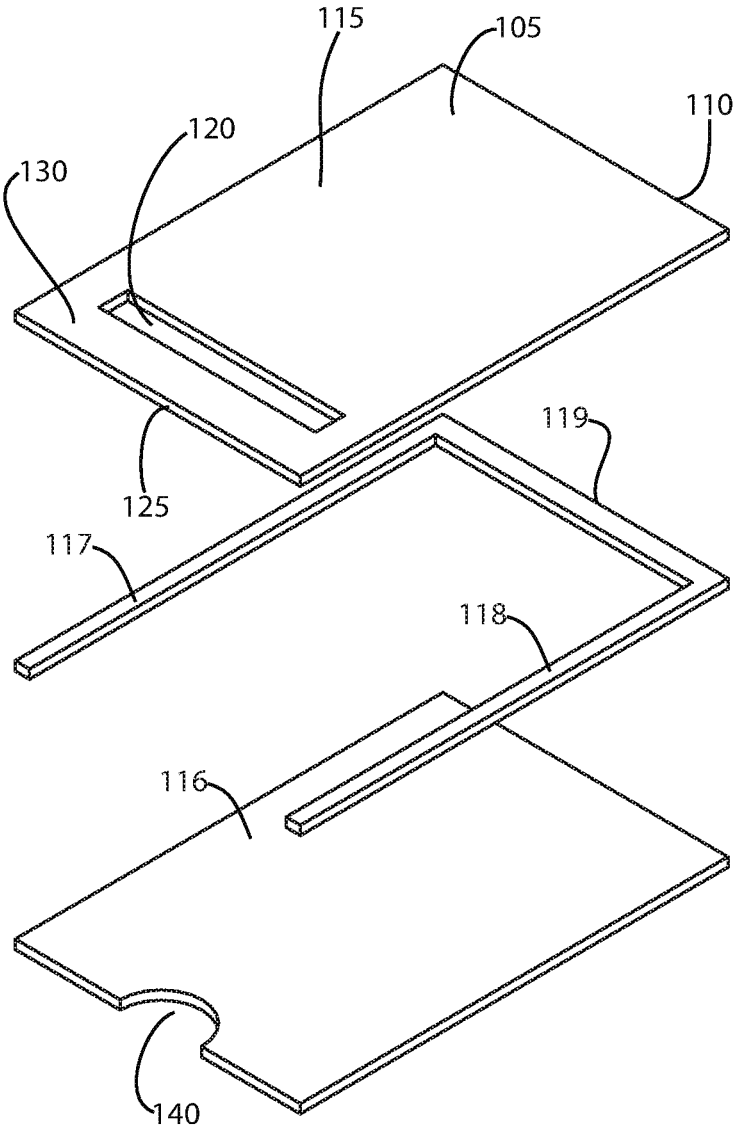
FIG. 11 is an exploded view of components for constructing the exemplary holder of FIG. 1 according to principles of the invention.
Figure 12:
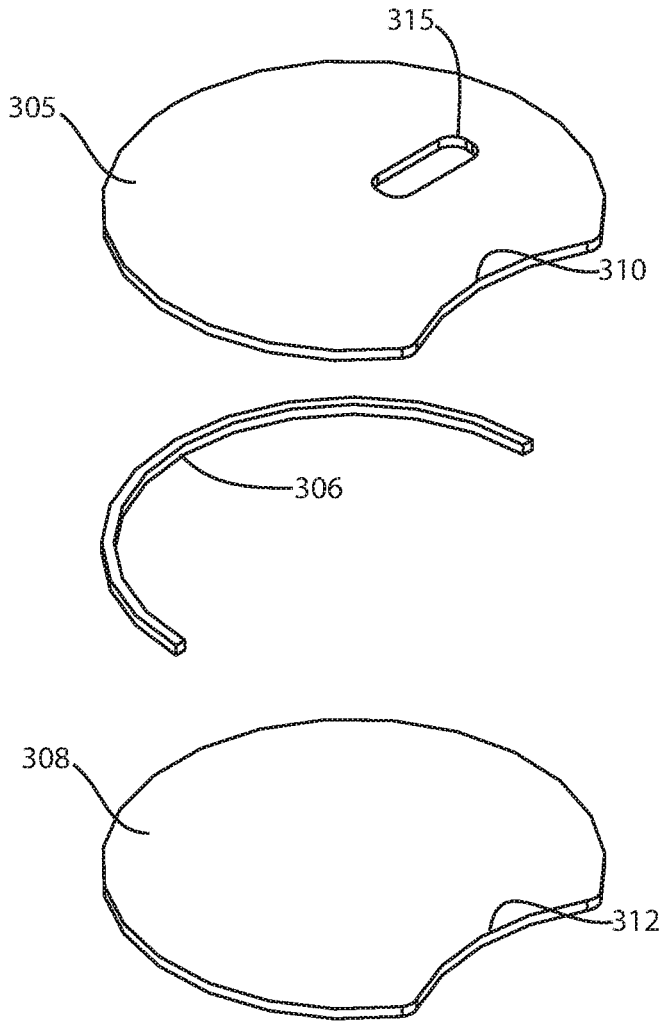
FIG. 12 is an exploded view of components for constructing the exemplary holder of FIG. 7 according to principles of the invention.

Referring to FIGS. 11, 12, a holder according to principles of the invention may be constructed of separate parts. The separate parts may be formed by die-cutting, molding, casting, extruding, machining or other part formation processes. The parts may be comprised of paper, card stock, cardboard, plastic, metal, wood, fabric, leather and/or composites or any other material suitable for production of holder or sleeve. Parts may be joined together by bonding, such as by using an adhesive or by welding (e.g., ultrasonic welding). Alternatively, parts may be mechanically fastened, such as with rivets, screws, stitching, staples, and/or snap-fit connectors.

With reference to FIG. 11, the holder 100 of FIG. 1 may be constructed by forming window 120 in upper panel 115 and cutout 140 in lower panel 116. A three-sided 117-119 U-shaped spacer is then sandwiched between upper panel 115 and lower panel 116. The spacer defines a volume (i.e., compartment 135) between the panels 115, 116 into which a scorecard 200 may be received.

With reference to FIG. 12, the holder 300 of FIG. 7 may be constructed by forming window 315 in upper panel 305 and coves 310, 312 in upper panel 305 and lower panel 308. A C-shaped spacer 306 is then sandwiched between upper panel 305 and lower panel 308, opposite the coves 310, 312. The spacer defines a volume (i.e., a compartment) between the panels 305, 308 into which a scorecard 400 may be received and rotated.

Figure 13:
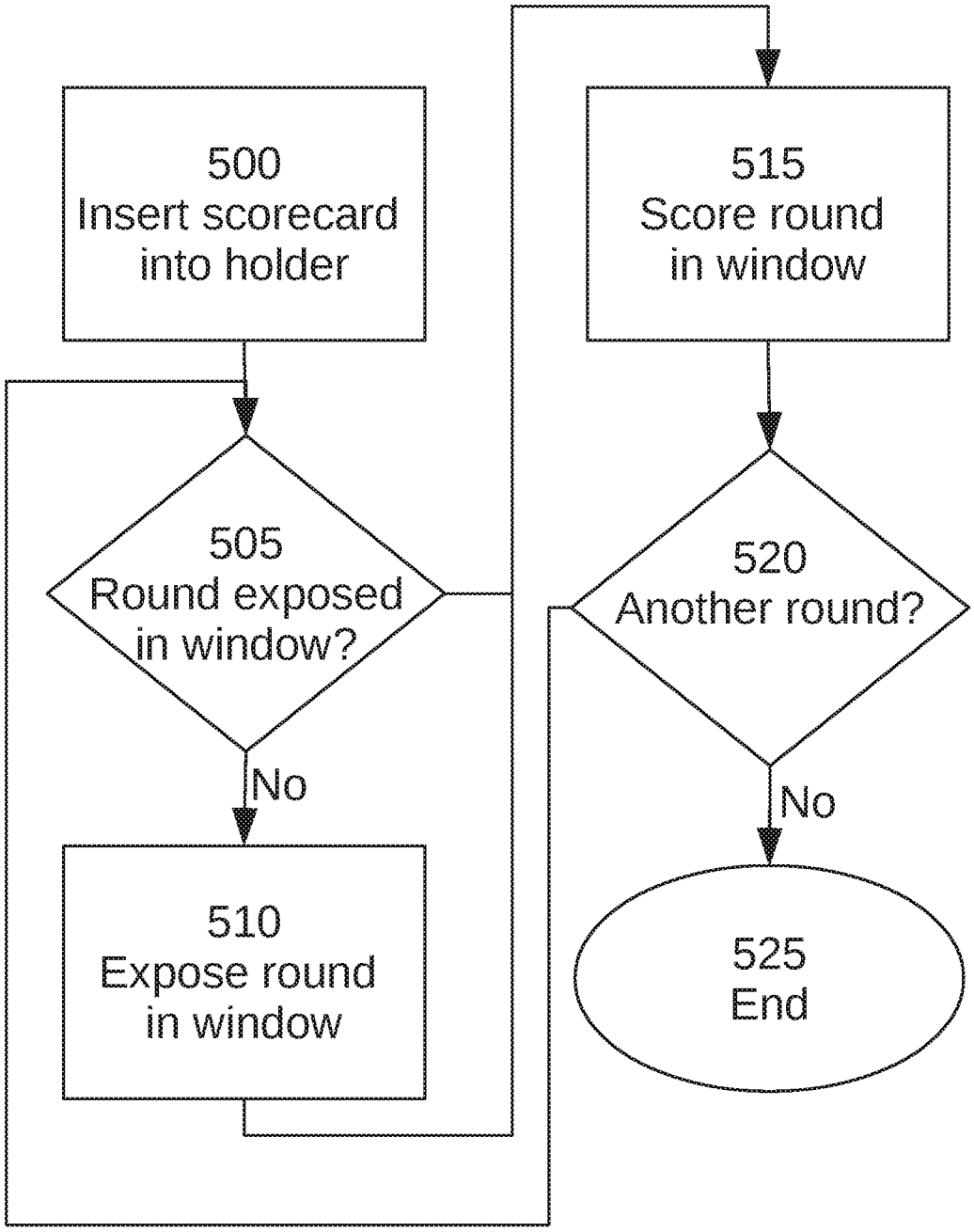
FIG. 13 is a flowchart for a method of using a scorecard holder according to principles of the invention.

With reference to the flowchart of FIG. 13, a method of scoring according to principles of the invention entails using a holder and scorecard according to principles of the invention. In step 500, the scorecard is inserted into the holder. In step 505, if the round to be played (or currently being played) is not exposed in the window, then, in step 510, the scorecard is moved (e.g., slid or rotated) to align the round on the scorecard with the window of the holder, such that the round number and scoring space(s) are exposed in the window. After a player completes the round, the player's score for the round is written in the player's assigned space for the round, as in step 515. When a round of play is completed, if there are additional rounds to be played, as determined in step 520, then the process proceeds from step 505, with a determination if the next (now current) round to be played is exposed in the window. Steps 505 through 520 repeat until all rounds have been played and scored, with no rounds remaining to be played. Then the process ends, as in step 525. By exposing a round to be scored in the window, using a holder and scorecard according to principles of the invention, all previously scored rounds are concealed. Thus each player may focus on the current round, without distraction from prior scored prior rounds of play.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of scoring a plurality of rounds of play, the method comprising steps of:

inserting a scorecard into a holder, the scorecard comprising a sheet with a surface on which indicia is displayed, the indicia including an identifier for each of a plurality of rounds and a scoring space for each identifier, each identifier and scoring space being separated from each other identifier and scoring space; and the holder comprising an upper panel, a lower panel, a compartment between the upper panel and lower panel, the compartment being sized and shaped to receive the scorecard, and a window in the upper panel, the window being sized and shaped to expose a scoring space and an identifier for a round of the plurality of rounds, and the lower panel of the holder including a semicircular cutout for engaging the scorecard;

if an identifier for a first round is not exposed in the window, then moving the scorecard relative to the holder to align the identifier for the first round and a scoring space for the identifier for the first round with the window of the holder, such that the identifier for the first round and the scoring space for the identifier for the first round are exposed in the window;

writing a score in the scoring space for the identifier for the first round exposed in the window;

moving the scorecard relative to the holder to align an identifier for a second round to be played and a scoring space for the identifier for the second round to be played with the window of the holder, such that the identifier for the second round and the scoring space for the identifier for the second round are exposed in the window and the scoring space for the identifier for the first round is concealed by the upper panel of the holder; and writing a score in the scoring space for the identifier for the second round exposed in the window;

moving the scorecard relative to the holder to align an identifier for a third round to be played and a scoring space for the identifier for the third round to be played with the window of the holder, such that the identifier for the third round and the scoring space for the identifier for the third round are exposed in the window and the scoring space for the identifier for the second round is concealed by the upper panel of the holder, and the scoring space for the identifier for the first round is concealed by the upper panel of the holder; and writing a score in the scoring space for the identifier for the third round exposed in the window.

2. The method of scoring a plurality of rounds of play of claim 1, wherein moving the scorecard relative to the holder comprises linearly sliding the scorecard relative to the holder.

3. The method of scoring a plurality of rounds of play of claim 1, wherein moving the scorecard relative to the holder comprises rotating the scorecard relative to the holder.

4. The method of scoring a plurality of rounds of play of claim 1, the scorecard comprising a rectangular sheet.

5. The method of scoring a plurality of rounds of play of claim 1, the scorecard comprising a circular sheet.

6. The method of scoring a plurality of rounds of play of claim 1, the upper panel and the lower panel of the holder including aligned concavities for engaging the scorecard.

7. A method of scoring a plurality of rounds of play, the method comprising steps of:

first, inserting a scorecard into a holder, the scorecard comprising a sheet with surface on which indicia is displayed, the indicia including an integer for each of a plurality of rounds and a scoring space for each integer, each integer and scoring space being separated from each other integer and scoring space, and the lower panel of the holder including a semicircular cutout for engaging the scorecard; and the holder comprising an upper panel, a lower panel, a compartment between the upper panel and lower panel, the compartment being sized and shaped to receive the scorecard, and a window in the upper panel, the window being sized and shaped to expose a scoring space and an integer for a round of the plurality of rounds;

second, moving the scorecard relative to the holder to align an integer for a first round and a scoring space for the integer for the first round with the window of the holder, such that the integer for the first round and the scoring space for the integer for the first round are exposed in the window;

third, writing a score in the scoring space for the integer for the round exposed in the window;

fourth, moving the scorecard relative to the holder to align an integer for a next round and a scoring space for the integer for the next round with the window of the holder, such that the integer for the next round and the scoring space for the integer for the next round are exposed in the window and the scoring space for the integer for the first round is concealed by the upper panel of the holder; and repeating steps three and four until a score has been written in the scoring space for each integer for each round of the plurality of rounds.

8. The method of scoring a plurality of rounds of play of claim 7, wherein moving the scorecard relative to the holder comprises linearly sliding the scorecard relative to the holder.

9. The method of scoring a plurality of rounds of play of claim 7, wherein moving the scorecard relative to the holder comprises rotating the scorecard relative to the holder.

10. The method of scoring a plurality of rounds of play of claim 7, the plurality of rounds of play consisting of 9 rounds, each round being identified by an integer from 1 to 9.

11. The method of scoring a plurality of rounds of play of claim 7, the plurality of rounds of play consisting of 18 rounds, each round being identified by an integer from 1 to 18.

12. The method of scoring a plurality of rounds of play of claim 7, the scorecard comprising a rectangular sheet.

13. The method of scoring a plurality of rounds of play of claim 7, the scorecard comprising a circular sheet.

14. The method of scoring a plurality of rounds of play of claim 7, the upper panel and the lower panel of the holder including aligned concavities for engaging the scorecard.

15. A system for scoring a plurality of rounds of play, the system comprising:

a holder and a scorecard, the scorecard comprising a sheet with a surface on which indicia is displayed, the indicia including an integer for each of a plurality of rounds and a scoring space for each integer, each integer and scoring space being separated from each other integer and scoring space; and the holder comprising an upper panel, a lower panel, a compartment between the upper panel and lower panel, the compartment being sized and shaped to receive the scorecard, and a window in the upper panel, the window being sized and shaped to expose a scoring space and an integer for a round of the plurality of rounds, and all integers and scoring spaces for previously scored rounds being concealed by the upper panel, and the lower panel of the holder including a concave portion for engaging the scorecard; and the scorecard being movable relative to the holder to individually align each integer and scoring space for each round with the window of the holder, and the compartment being sized and shaped to receive enough of the scorecard to align each of the plurality of integers and scoring spaces with the window.

16. The method of scoring a plurality of rounds of play of claim 15, the scorecard comprising a rectangular sheet and the scorecard being movable linearly relative to the holder.

17. The method of scoring a plurality of rounds of play of claim 15, the scorecard comprising a circular sheet and the scorecard being rotatable relative to the holder.

* * * * *